US012612272B2

(12) United States Patent
Fuchi

(10) Patent No.: US 12,612,272 B2
(45) Date of Patent: Apr. 28, 2026

(54) SHEET STORAGE DEVICE AND IMAGE FORMATION SYSTEM INCLUDING SAME

(71) Applicant: KYOCERA Document Solutions Inc., Osaka (JP)

(72) Inventor: Masami Fuchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 117 days.

(21) Appl. No.: 18/731,626

(22) Filed: Jun. 3, 2024

(65) Prior Publication Data

US 2024/0400325 A1 Dec. 5, 2024

(30) Foreign Application Priority Data

Jun. 5, 2023 (JP) ..... 2023-092372

(51) Int. Cl.
*B65H 1/14* (2006.01)

(52) U.S. Cl.
CPC ..... *B65H 1/14* (2013.01); *B65H 2405/11* (2013.01); *B65H 2801/12* (2013.01)

(58) Field of Classification Search
CPC ... B65H 1/14; B65H 2405/11; B65H 2801/12
See application file for complete search history.

(56) References Cited

U.S. PATENT DOCUMENTS

| | | | | |
|---|---|---|---|---|
| 9,199,809 | B2 * | 12/2015 | Hamasaki | B65H 7/06 |
| 2016/0334747 | A1 * | 11/2016 | Wakabayashi | G03G 15/6502 |
| 2018/0222700 | A1 * | 8/2018 | Okazaki | B65H 3/0684 |
| 2022/0269208 | A1 * | 8/2022 | Ando | G03G 15/6511 |

FOREIGN PATENT DOCUMENTS

| | | | |
|---|---|---|---|
| JP | 4-26138 | * | 1/1992 |
| JP | 8-217266 | A | 8/1996 |
| JP | 9-749 | * | 1/1997 |

* cited by examiner

*Primary Examiner* — Thomas A Morrison
(74) *Attorney, Agent, or Firm* — Stein IP, LLC

(57) ABSTRACT

A predetermined frame includes a main frame part and a drum arrangement part. Winding drums are disposed in a drum arrangement part. Relay pulleys includes a first relay pulley disposed in the drum arrangement part, for a first wire to wrap around, a second relay pulley disposed on the same axis as the first relay pulley, outward of the first relay pulley, for a second wire to wrap around, and a third relay pulley disposed in the main frame part, for the second wire to wrap around. The drum arrangement part is positioned inward of the main frame part.

7 Claims, 11 Drawing Sheets

SHEET STORAGE DEVICE AND IMAGE FORMATION SYSTEM INCLUDING SAME

INCORPORATION BY REFERENCE

This application is based upon and claims the benefit of priority from the corresponding Japanese Patent Application No. 2023-092372 filed Jun. 5, 2023, the entire contents of which are hereby incorporated by reference.

BACKGROUND

The present disclosure relates to a sheet storage device and an image formation system including the same.

A conventional sheet storage device is equipped with a setting plate on which sheets are set. The setting plate is supported in a manner movable up and down. When the setting plate moves upward, a position of an upper surface of the top one of sheets on the setting plate is maintained at a predetermined position.

For instance, a conventional setting plate is linked with a wire. Then, the wire linked with the setting plate is wound or unwound, so as to move the setting plate upward or downward.

SUMMARY

A sheet storage device according to a first aspect of the present disclosure includes a setting plate, a pair of plate-like frame, a wire, a plurality of winding drums, and a plurality of relay pulleys. The setting plate is capable of reciprocating in the up and down direction, and sheets are set on the setting plate. The pair of plate-like frames are disposed to face each other with the setting plate between them, in a first direction perpendicular to the up and down direction. The wire is linked with both end parts of the setting plate in the first direction. The plurality of winding drums are disposed outward in the first direction of each of the pair of plate-like frames, and are linked with the wire, in a rotatable manner about an axis extending in the first direction. When being rotated in one direction, the winding drums wind the wire so as to move the setting plate upward, while when being rotated in the other direction, the winding drums unwind the wire so as to move the setting plate downward. The plurality of relay pulleys are disposed outward in the first direction of each of the pair of plate-like frames, in a rotatable manner about an axis extending in the first direction, and the wire wraps around the relay pulleys. A predetermined one of the pair of plate-like frames includes a main frame part and a drum arrangement part. The drum arrangement part is disposed on one side of the main frame part in a second direction perpendicular to the first direction. The wire includes a first wire and a second wire. The first wire is linked with one side end part of the setting plate in the second direction, on the predetermined frame side. The second wire is linked with the other side end part of the setting plate in the second direction, on the predetermined frame side. The winding drums on the predetermined frame side out of the plurality of winding drums are disposed in the drum arrangement part. The relay pulleys on the predetermined frame side out of the plurality of relay pulleys include a first relay pulley, a second relay pulley, and a third relay pulley. The first relay pulley is disposed in the drum arrangement part, and the first wire wraps around the first relay pulley. The second relay pulley is disposed on the same axis as the first relay pulley, outward of the first relay pulley in the first direction, and the second wire wraps around the second relay pulley. The third relay pulley is disposed in the main frame part, and the second wire wraps around the third relay pulley. The drum arrangement part is disposed inward of the main frame part in the first direction.

An image formation system according to a second aspect of the present disclosure includes the sheet storage device described above, and an image forming apparatus. The image forming apparatus is linked with the sheet storage device. The sheet storage device feeds the image forming apparatus with the sheet. The image forming apparatus performs printing on the sheet fed from the sheet storage device.

DETAILED DESCRIPTION

Hereinafter, with reference to FIGS. 1 to 10, there are described a sheet storage device 100 according to an embodiment of the present disclosure and an image formation system 100S including the same.

<Structure of Image Formation System>

Figure 1:
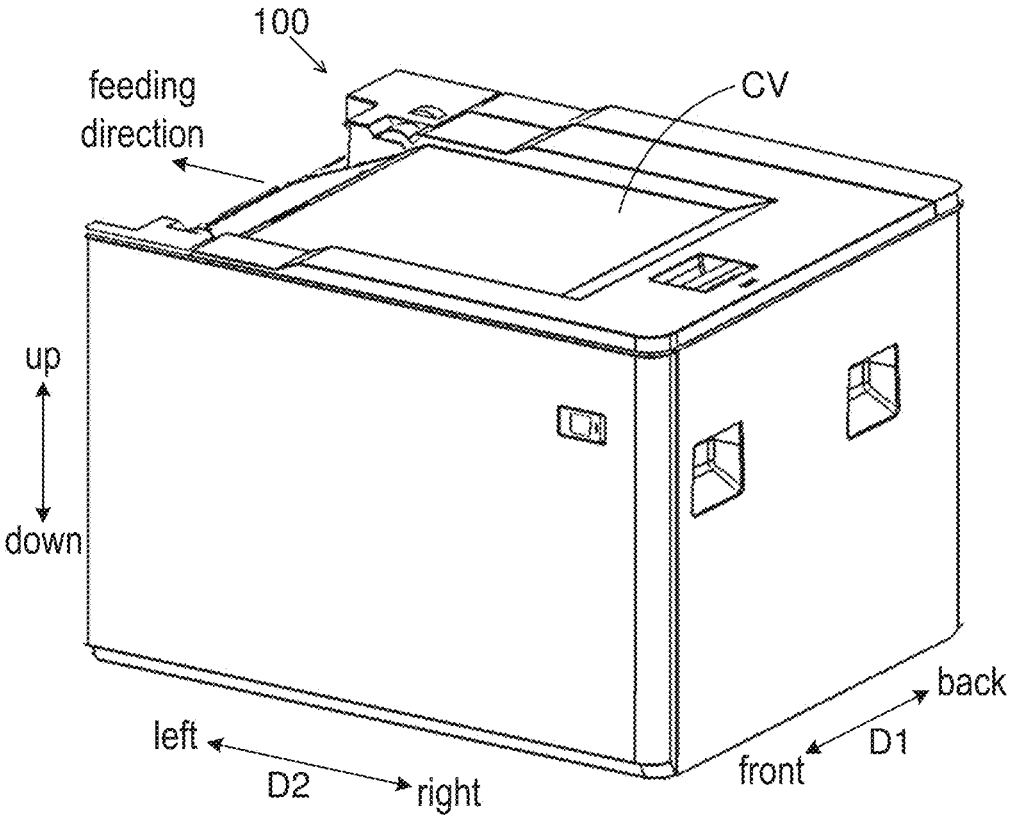
FIG. 1 is a perspective view of a sheet storage device according to an embodiment.
Figure 2:
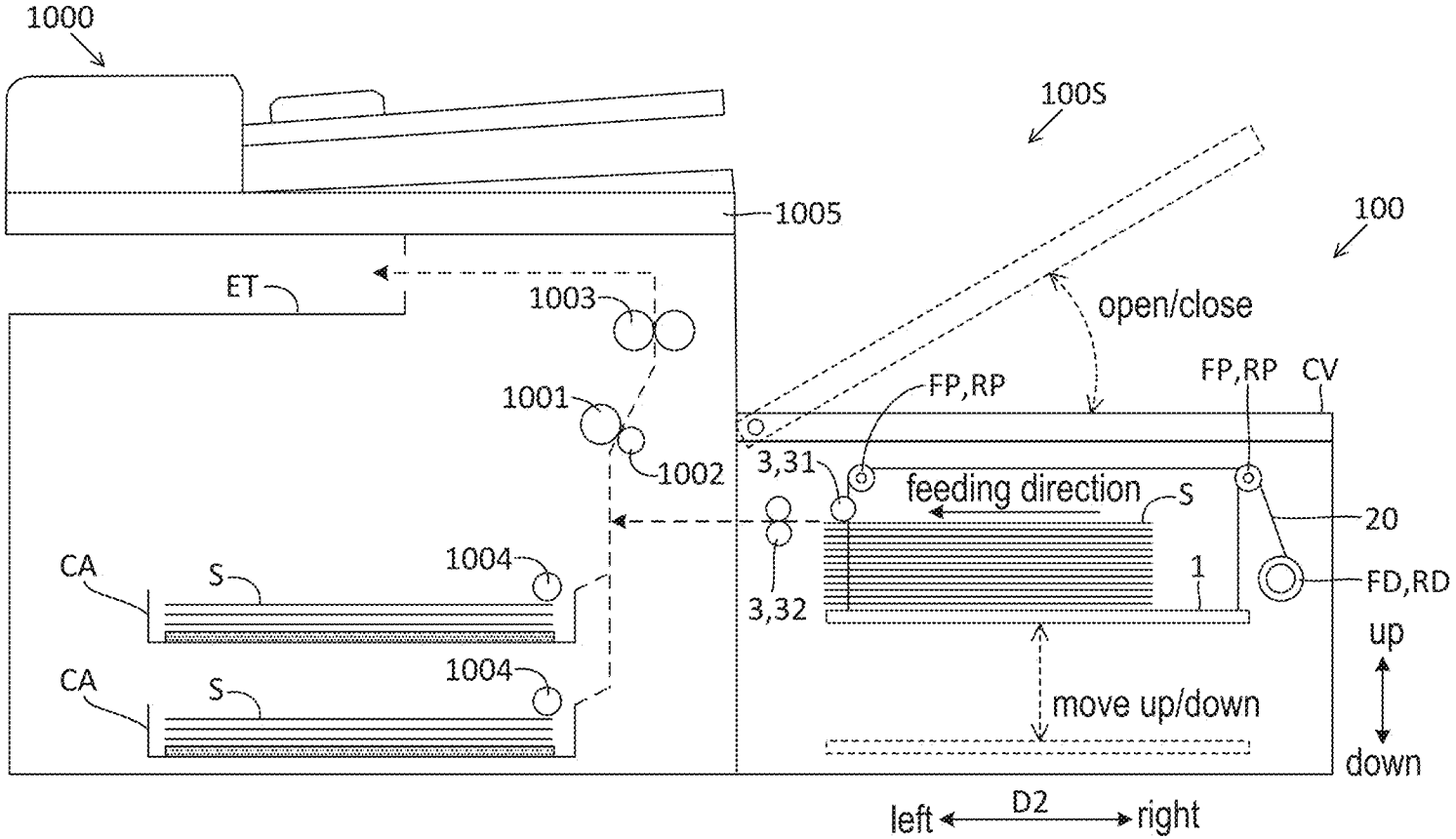
FIG. 2 is a schematic diagram of an image formation system including the sheet storage device according to the embodiment.

The sheet storage device 100 has an appearance as illustrated in FIG. 1. The sheet storage device 100 is linked with an image forming apparatus 1000 as illustrated in FIG. 2. When being linked with the image forming apparatus 1000, the sheet storage device 100 constitutes the image formation system 100S with the image forming apparatus 1000. FIG. 2 is a schematic diagram of the image formation system 100S (i.e., the sheet storage device 100 linked with the image forming apparatus 1000). FIG. 2 corresponds to a case where the image formation system 100S is viewed from front.

The sheet storage device 100 is installed with the image forming apparatus 1000 on a floor. The direction perpendicular to the floor (a flat surface) on which the sheet storage device 100 is installed corresponds to an "up and down direction".

Here, in horizontal directions perpendicular to the up and down direction, one direction corresponds to a "first direction", and the other direction perpendicular to the one direction corresponds to a "second direction". In the following description, the one direction of the horizontal directions is denoted by D1 and is simply referred to as a first direction D1, while the other direction of the horizontal directions is denoted by D2 and is simply referred to as a second direction D2.

The first direction D1 corresponds to a front and back direction when viewing the sheet storage device 100 from front. One side in the first direction D1 is a front side (i.e., a near side when viewing the device from front), and the other side opposite to the one side in the first direction D1 is a back side (i.e., a far side when viewing the device from front).

The second direction D2 corresponds to a left and right direction when viewing the sheet storage device 100 from front. One side in the second direction D2 is a right side, and the other side opposite to the one side in the second direction D2 is a left side.

The sheet storage device 100 is attachable and detachable from the image forming apparatus 1000. The sheet storage device 100 may be an optional device. The sheet storage device 100 is disposed on the right side of the image forming apparatus 1000.

The sheet storage device 100 stores sheets S. For instance, the sheet S is a paper sheet. The sheet storage device 100 feeds the sheet S to the image forming apparatus 1000. In other words, the sheet storage device 100 functions as a feeding device.

On the right side of the image forming apparatus 1000, the sheet storage device 100 feeds the sheet S to the image forming apparatus 1000, from the right side to the left side. In other words, in the second direction D2, the direction from the right side to the left side is a feeding direction of the sheet S from the sheet storage device 100 to the image forming apparatus 1000. In this structure, the first direction D1 is a direction perpendicular to the feeding direction of the sheet S.

The image forming apparatus 1000 prints an image on the sheet S fed from the sheet storage device 100. A printing method of the image forming apparatus 1000 is an electrophotographic method. It may also be possible that the printing method of the image forming apparatus 1000 is an inkjet method.

<Structure of Image Forming Apparatus>

The image forming apparatus 1000 conveys the sheet S fed from the sheet storage device 100, along a conveying path. The image forming apparatus 1000 prints an image on the sheet S under conveyance. Note that the conveying path of the sheet S is shown by a broken line with an arrow in FIG. 2.

The image forming apparatus 1000 includes a photosensitive drum 1001 and a transfer roller 1002. The photosensitive drum 1001 carries a toner image on its outer circumference surface. The transfer roller 1002 is pressed to contact the photosensitive drum 1001, so as to form a transfer nip with the photosensitive drum 1001. The transfer roller 1002 rotates together with the photosensitive drum 1001. When the sheet S under conveyance enters in the transfer nip, a transfer process is performed on the sheet S, and the toner image is transferred onto the sheet S.

Although not illustrated, the image forming apparatus 1000 further includes a charging device, an exposure device, and a development device. The charging device charges the outer circumference surface of the photosensitive drum 1001. The exposure device forms an electrostatic latent image on the outer circumference surface of the photosensitive drum 1001. The development device develops the electrostatic latent image on the outer circumference surface of the photosensitive drum 1001 into the toner image.

The image forming apparatus 1000 includes a fixing roller pair 1003. The fixing roller pair 1003 includes a heating roller and a pressure roller. A heater is embedded in the heating roller. The pressure roller is pressed to contact the heating roller so as to form a fixing nip with the heating roller. The pressure roller rotates with the heating roller. When the sheet S under conveyance enters the fixing nip, a fixing process is performed on the sheet S, and the toner image is fixed to the sheet S. The sheet S after passing through the fixing nip is discharged onto a discharge tray ET.

Note that the image forming apparatus 1000 includes a feed roller 1004. The feed roller 1004 feeds the sheet S to the conveying path from a sheet cassette CA disposed in a main body of the image forming apparatus 1000. In other words, the image forming apparatus 1000 can also print on the sheet S set in the sheet cassette CA.

In addition, the image forming apparatus 1000 includes an image reading device 1005. The image reading device 1005 reads an original so as to generate image data of the original. The image forming apparatus 1000 can print an image based on the image data of the original on the sheet S (i.e., can copy the original).

<Structure of Sheet Storage Device>

Figure 3:
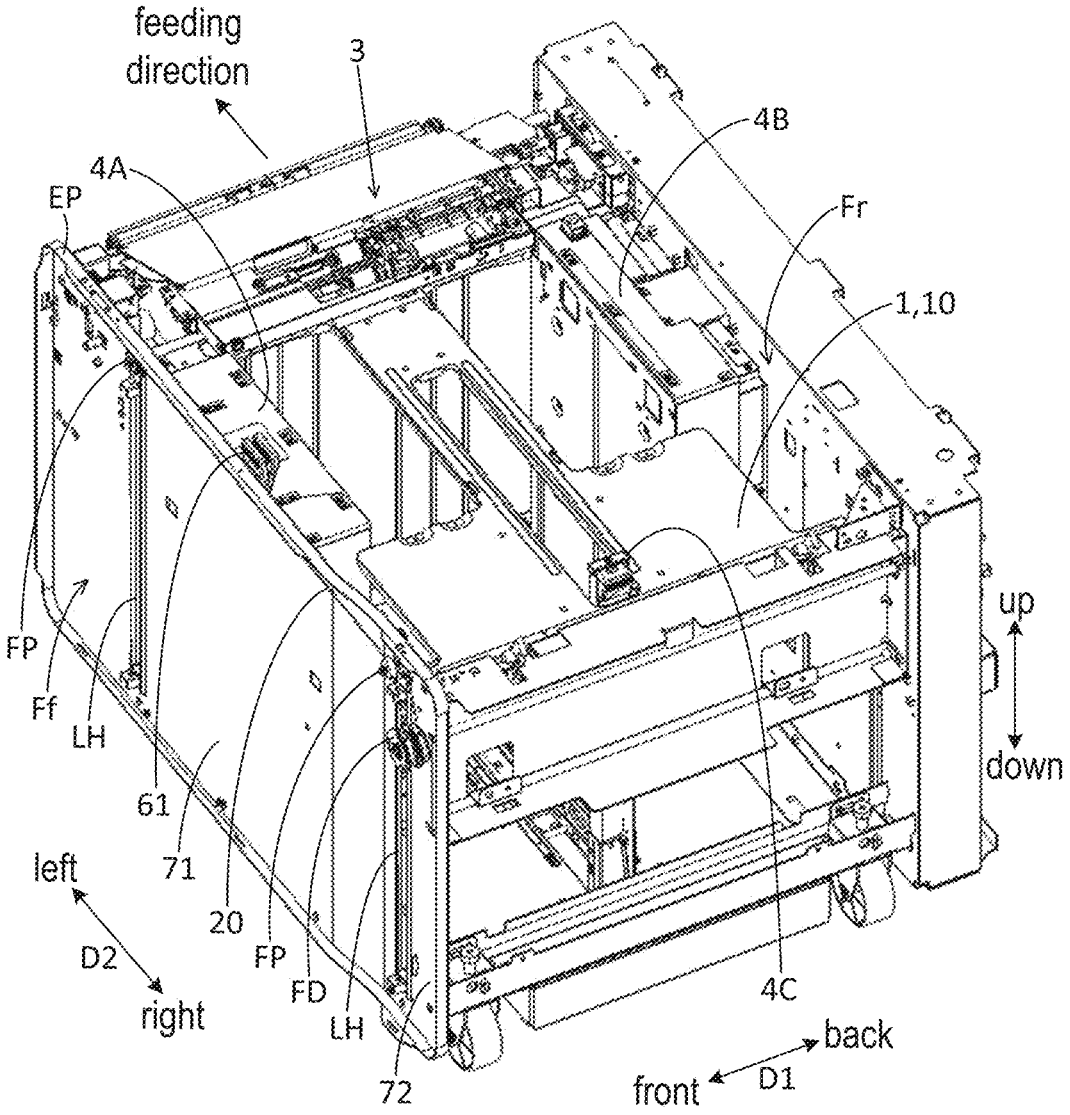
FIG. 3 is a perspective view of the sheet storage device according to the embodiment, without an outer cover.

As illustrated in FIG. 3, the sheet storage device 100 has a front frame Ff and a rear frame Fr. The front frame Ff and the rear frame Fr are plate-like frames and are made of metal sheet. The front frame Ff and the rear frame Fr correspond to a "pair of plate-like frames". The front frame Ff is disposed on the front side, and the rear frame Fr is disposed on the back side. The front frame Ff has a front surface part whose thickness direction is the first direction D1, and the rear frame Fr has a rear surface part whose thickness direction is the first direction D1. The front frame Ff and the rear frame Fr are disposed in such a manner that the front surface part and the rear surface part face each other in the first direction D1.

The sheet storage device 100 has a sheet storage region, which is a region between the front frame Ff and the rear frame Fr in the first direction D1. The sheet storage region is covered with a top cover CV from above (see FIGS. 1 and 2).

The top cover CV is supported in a pivotable manner with respect to the front frame Ff and the rear frame Fr. The top cover CV is pivotable about an axis extending in the first direction D1. The top cover CV pivots on a fulcrum of the left side end part so as to move the right side end part upward and downward. In other words, the top cover CV opens and closes an upper opening of the sheet storage region.

When the right side end part of the top cover CV is moved upward (in other words, when opening the top cover CV), the upper opening of the sheet storage region is exposed. Further, in the state where the top cover CV is opened, the sheets S are put in the sheet storage region through the upper opening of the sheet storage region. In this state, the right side end part of the top cover CV is moved downward (in other words, the top cover CV is closed), and thus the upper opening of the sheet storage region is closed.

The sheet storage device 100 includes a setting plate 1. The setting plate 1 is made of metal sheet. The setting plate 1 is disposed in the sheet storage region that is a region between the front frame Ff and the rear frame Fr in the first direction D1. In other words, the front frame Ff and the rear frame Fr are disposed so as to face each other in the first direction D1 with the setting plate 1 between them. Further, in other words, the front frame Ff and the rear frame Fr are disposed outward in the first direction D1 of the setting plate 1. The front frame Ff is disposed frontward in the first direction D1 of the setting plate 1. The rear frame Fr is disposed backward in the first direction D1 of the setting plate 1.

Note that "outward in the first direction D1" means the direction from the center of the sheet storage region in the first direction D1 to the front side or the back side of the sheet storage region in the first direction D1. For instance, "outward in the first direction D1 of the front frame Ff" means the front side of the front frame Ff in the first direction D1 (i.e., the outside opposite to the sheet storage region side of the front frame Ff), and "outward in the first direction D1 of the rear frame Fr" means the back side of the rear frame Fr in the first direction D1 (i.e., the outside opposite to the sheet storage region side of the rear frame Fr).

On the other hand, "inward in the first direction D1" means the direction from the front side or the back side of the sheet storage region in the first direction D1 to the center of the sheet storage region in the first direction D1. For instance, "inward in the first direction D1 of the front frame Ff" means the back side of the front frame Ff in the first direction D1 (i.e., the sheet storage region side of the front frame Ff), and "inward in the first direction D1 of the rear frame Fr means the front side of the rear frame Fr in the first direction D1 (i.e., the sheet storage region side of the rear frame Fr).

The setting plate 1 has a setting part 10 in which the sheets S are set, in the sheet storage region. The sheets S are stacked in the up and down direction on the setting plate 1. The setting plate 1 is supported in a manner capable of reciprocating in the up and down direction.

Figure 4:
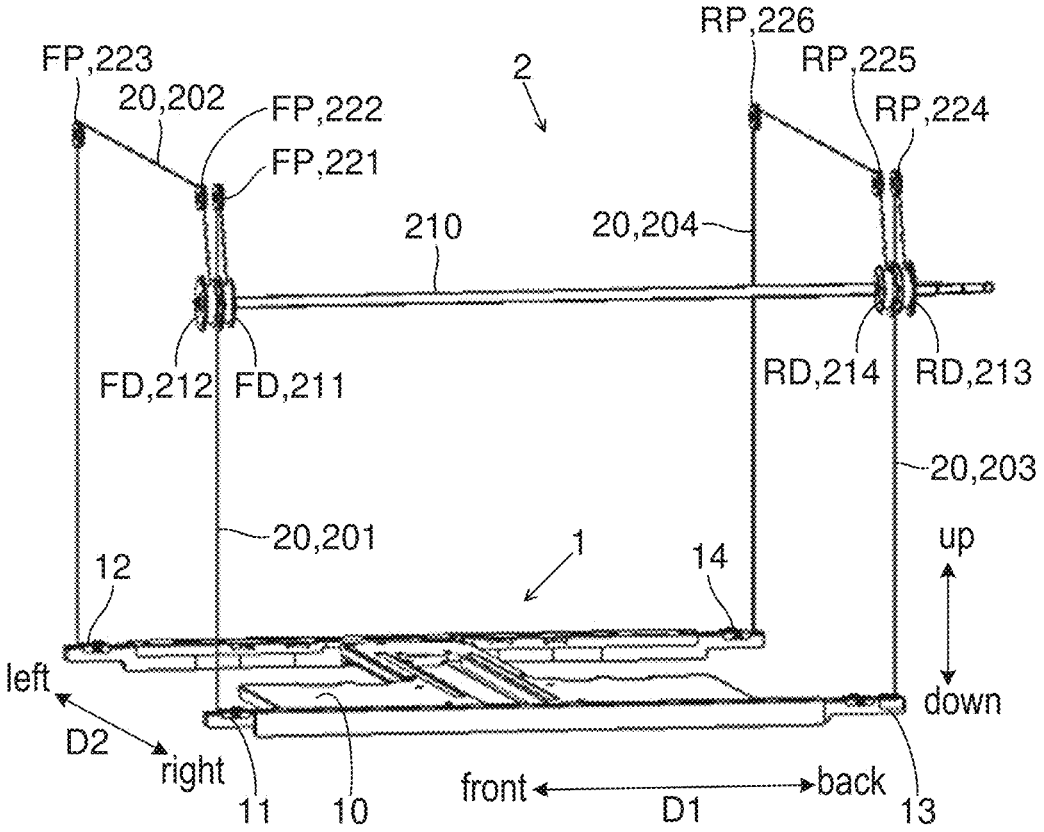
FIG. 4 is a perspective view of an elevating mechanism of a setting plate in the sheet storage device according to the embodiment.
Figure 5:
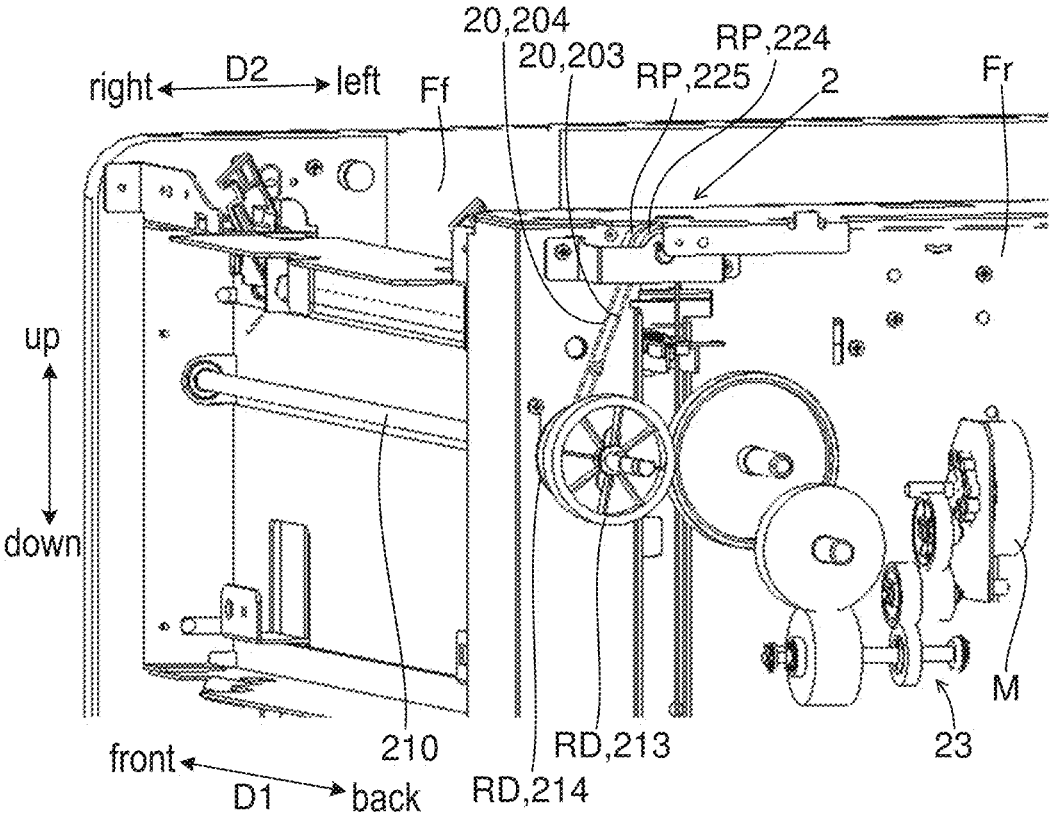
FIG. 5 is a perspective view of a winding motor and its vicinity of the elevating mechanism illustrated in FIG. 4.

The sheet storage device 100 includes an elevating mechanism 2. A structure of the elevating mechanism 2 is illustrated in FIGS. 4 and 5. The elevating mechanism 2 reciprocates the setting plate 1 in the up and down direction. The elevating mechanism 2 moves the setting plate 1 upward, so as to maintain a position in the up and down direction of the top one of the sheets S set on the setting plate 1.

The elevating mechanism 2 includes wires 20 linked with both end parts of the setting plate 1 in the first direction D1. The elevating mechanism 2 winds or unwinds the wires 20 so as to move the setting plate 1 upward or downward.

The wires 20 include a first wire 201 whose one end is linked with a right front side end part of the setting plate 1, a second wire 202 whose one end is linked with a left front side end part of the setting plate 1, a third wire 203 whose one end is linked with a right back side end part of the setting plate 1, and a fourth wire 204 whose one end is linked with a left back side end part of the setting plate 1.

Specifically, the setting plate 1 has four linking parts 11, 12, 13, and 14. The linking part 11 is disposed at the right front end of the setting part 10, the linking part 12 is disposed at the left front end of the setting part 10, the linking part 13 is disposed at the right rear end of the setting part 10, and the linking part 14 is disposed at the left rear end of the setting part 10. In addition, the front frame Ff has long holes LH (see FIG. 3) whose longitudinal direction is the up and down direction, penetrating in the thickness direction, on the right side and the left side in the second direction D2. Although not illustrated, similarly, the rear frame Fr also has long holes whose longitudinal direction is the up and down direction, penetrating in the thickness direction, on the right side and the left side in the second direction D2.

The linking part 11 protrudes outward in the first direction D1 of the front frame Ff (i.e., to the front side), through the long hole LH of the front frame Ff on the right side in the second direction D2. The linking part 12 protrudes outward in the first direction D1 of the front frame Ff (i.e., to the front side), through the long hole LH of the front frame Ff on the left side in the second direction D2. The linking part 13 protrudes outward in the first direction D1 of the rear frame Fr (i.e., to the back side), through the long hole of the rear frame Fr on the right side in the second direction D2. The linking part 14 protrudes outward in the first direction D1 of the rear frame Fr (i.e., to the back side), through the long hole of the rear frame Fr on the left side in the second direction D2.

Further, the first wire 201 is linked with the linking part 11. The second wire 202 is linked with the linking part 12. The third wire 203 is linked with the linking part 13. The fourth wire 204 is linked with the linking part 14.

The elevating mechanism 2 includes a front side winding drum FD, a back side winding drum RD, a front side relay pulley FP, a back side relay pulley RP, and a winding motor M. The front side winding drum FD and the back side winding drum RD correspond to "winding drums". The front side relay pulley FP and the back side relay pulley RP correspond to "relay pulleys".

The front side winding drum FD includes a first winding drum 211 linked with the other end of the first wire 201, and a second winding drum 212 linked with the other end of the second wire 202. The back side winding drum RD includes a third winding drum 213 linked with the other end of the third wire 203, and a fourth winding drum 214 linked with the other end of the fourth wire 204. Each of the front side winding drum FD and the back side winding drum RD rotates in one direction so as to wind the wire 20 linked with itself, and rotates in the other direction so as to unwind the wire 20 linked with itself.

The front side winding drum FD is disposed outward in the first direction D1 of the front frame Ff. On the other hand, the back side winding drum RD is disposed outward in the first direction D1 of the rear frame Fr. Note that, although not illustrated, the first winding drum 211 and the second winding drum 212 may be constituted of a single winding drum. Similarly, the third winding drum 213 and the fourth winding drum 214 may be constituted of a single winding drum. In other words, the first winding drum 211 and the second winding drum 212 may be integrated with each other, and the third winding drum 213 and the fourth winding drum 214 may be integrated with each other.

The first winding drum 211 and the second winding drum 212 are arranged in this order from the front frame Ff side outward in the first direction D1. The fourth winding drum 214 and the third winding drum 213 are arranged in this order from the rear frame Fr side outward in the first direction D1.

In addition, the first to fourth winding drums 211 to 214 are supported in a rotatable manner about the same axis extending in the first direction D1. In other words, the second winding drum 212 is disposed outward of the first winding drum 211 in the first direction D1, on the same axis as the first winding drum 211. The third winding drum 213 is disposed outward of the fourth winding drum 214 in the first direction D1, on the same axis as the fourth winding drum 214.

Specifically, the first to fourth winding drums 211 to 214 are attached to the same rotation shaft 210 and rotate with the rotation shaft 210. One end part of the rotation shaft 210 in the axis direction is supported by the front frame Ff in a rotatable manner, and the other end part opposite to the one end part in the axis direction is supported by the rear frame Fr in a rotatable manner, so that the rotation shaft 210 extends in parallel to the first direction D1. The first winding drum 211 and the second winding drum 212 are disposed in the right side end part of the front frame Ff in the second direction D2, while the third winding drum 213 and the fourth winding drum 214 are disposed in the right side end part of the rear frame Fr in the second direction D2. In other words, one end part of the rotation shaft 210 is supported in a rotatable manner by the right side end part of the front frame Ff in the second direction D2, and the other end part of the rotation shaft 210 is supported in a rotatable manner by the right side end part of the rear frame Fr in the second direction D2.

When the winding motor M is driven, it rotates the rotation shaft 210. When the rotation shaft 210 rotates, the first to fourth winding drums 211 to 214 rotate. The winding motor M is disposed outward in the first direction D1 of the rear frame Fr. The winding motor M is linked with the back side end part of the rotation shaft 210 with a transmission mechanism 23 including a plurality of gears such as a screw gear.

The front side relay pulley FP is disposed outward in the first direction D1 of the front frame Ff. The front side relay pulley FP is disposed above the front side winding drum FD (i.e., the rotation shaft 210). The front side relay pulley FP is rotatable about an axis extending in the first direction D1. The front side relay pulley FP is supported in a rotatable manner by a rotation shaft (no numeral) attached to the front frame Ff. The wire 20 wraps around the front side relay pulley FP. The front side relay pulley FP includes a first relay pulley 221, a second relay pulley 222, and a third relay pulley 223.

The first relay pulley 221 is disposed in the right side end part of the front frame Ff in the second direction D2. The first relay pulley 221 is disposed in a vicinity of the front side winding drum FD, on the left side of the front side winding drum FD in the second direction D2. The first relay pulley 221 is disposed closer to the front side winding drum FD in the second direction D2 than the third relay pulley 223. In other words, the first relay pulley 221 is disposed on the right side of the third relay pulley 223 in the second direction D2. The first wire 201 wraps around the first relay pulley 221.

The second relay pulley 222 is disposed on the same axis as the first relay pulley 221. In other words, rotation shafts of the first relay pulley 221 and the second relay pulley 222 have the same position in the up and down direction, and the rotation shafts of the first relay pulley 221 and the second relay pulley 222 have the same position in the second direction D2.

In addition, the second relay pulley 222 is disposed outward in the first direction D1 of the first relay pulley 221. In other words, the second relay pulley 222 is disposed on the outside of the first relay pulley 221 opposite to the front frame Ff side. Further, in other words, the first relay pulley 221 and the second relay pulley 222 are arranged in this order from the front frame Ff side outward in the first direction D1. The second wire 202 wraps around the second relay pulley 222.

The third relay pulley 223 disposed on the left side of the second relay pulley 222 in the second direction D2. The third relay pulley 223 is disposed at a position farther from the front side winding drum FD in the second direction D2 than the second relay pulley 222. In other words, the third relay pulley 223 is disposed on the left side of the second relay pulley 222 in the second direction D2. The position of the third relay pulley 223 in the up and down direction is the same (or substantially the same) as the position of the second relay pulley 222 in the up and down direction. The position of the third relay pulley 223 in the first direction D1 is the same (or substantially the same) as the position of the second relay pulley 222 in the first direction D1. The second wire 202 wraps around the third relay pulley 223.

The back side relay pulley RP is disposed outward in the first direction D1 of the rear frame Fr. The back side relay pulley RP is disposed above the back side winding drum RD (i.e., the rotation shaft 210). The back side relay pulley RP is rotatable about an axis extending in the first direction D1. The back side relay pulley RP is supported in a rotatable manner by a rotation shaft (no numeral) attached to the rear frame Fr. The wire 20 wraps around the back side relay pulley RP. The back side relay pulley RP includes a fourth relay pulley 224, a fifth relay pulley 225, and a sixth relay pulley 226.

The fourth relay pulley 224 is disposed in the right side end part of the rear frame Fr in the second direction D2. The fourth relay pulley 224 is disposed in a vicinity of the back side winding drum RD, on the left side of the back side winding drum RD in the second direction D2. The fourth relay pulley 224 is disposed at a position closer to the back side winding drum RD in the second direction D2 than the sixth relay pulley 226. In other words, the fourth relay pulley 224 is disposed on the right side of the sixth relay pulley 226 in the second direction D2. The third wire 203 wraps around the fourth relay pulley 224.

The fifth relay pulley 225 is disposed on the same axis as the fourth relay pulley 224. In other words, rotation shafts of the fourth relay pulley 224 and the fifth relay pulley 225 have the same position in the up and down direction, and the rotation shafts of the fourth relay pulley 224 and the fifth relay pulley 225 have the same position in the second direction D2.

In addition, the fifth relay pulley 225 is disposed inward in the first direction D1 of the fourth relay pulley 224. In other words, the fifth relay pulley 225 is disposed on the rear frame Fr side of the fourth relay pulley 224. Further, in other words, the fifth relay pulley 225 and the fourth relay pulley 224 are arranged in this order from the rear frame Fr side outward in the first direction D1. The fourth wire 204 wraps around the fifth relay pulley 225.

The sixth relay pulley 226 is disposed on the left side of the fifth relay pulley 225 in the second direction D2. The sixth relay pulley 226 is disposed at a position farther from the back side winding drum RD in the second direction D2 than the fifth relay pulley 225. In other words, the sixth relay pulley 226 is disposed on the left side of the fifth relay pulley 225 in the second direction D2. The position of the sixth relay pulley 226 in the up and down direction is the same (or substantially the same) as the position of the fifth relay pulley 225 in the up and down direction. The position of the sixth relay pulley 226 in the first direction D1 is the same (or substantially the same) as the position of the fifth relay pulley 225 in the first direction D1. The fourth wire 204 wraps around the sixth relay pulley 226.

The first wire 201 extends from the linking part 11 of the setting plate 1, wraps around the first relay pulley 221, and reaches the first winding drum 211. The second wire 202 extends from the linking part 12 of the setting plate 1, wraps around the third relay pulley 223 and the second relay pulley 222 in this order, and reaches the second winding drum 212.

The third wire 203 extends from the linking part 13 of the setting plate 1, wraps around the fourth relay pulley 224, and reaches the third winding drum 213. The fourth wire 204 extends from the linking part 14 of the setting plate 1, wraps around the sixth relay pulley 226 and the fifth relay pulley 225 in this order, and reaches the fourth winding drum 214.

When the winding motor M rotates forward, the first to fourth winding drums 211 to 214 rotate in one direction, and the first to fourth winding drums 211 to 214 wind the first to fourth wires 201 to 204, respectively. In this way, the setting plate 1 moves upward. On the other hand, when the winding motor M rotates backward, the first to fourth winding drums 211 to 214 rotate in the other direction, and the first to fourth winding drums 211 to 214 unwind the first to fourth wires 201 to 204 respectively. In this way, the setting plate 1 moves downward.

As illustrated in FIGS. 2 and 3, the sheet storage device 100 includes a feeding unit 3. The feeding unit 3 feeds the sheet S from the sheet storage device 100 (i.e., the sheet storage region) to the image forming apparatus 1000. The feeding unit 3 includes a pickup roller 31 and a conveying roller pair 32.

The pickup roller 31 is supported in a rotatable manner. The pickup roller 31 is disposed at a position capable of contacting a downstream side end part of the sheet S in the feeding direction from above, in the state where the sheet S is set on the setting plate 1. The pickup roller 31 is supported in a rotatable manner. The pickup roller 31 contacts the sheet S set on the setting plate 1 from above and rotates in this state, so as to pull out the sheet S from the setting plate 1.

The conveying roller pair 32 is supported in a rotatable manner. The conveying roller pair 32 is a pair of rollers that are pressed to contact each other. The conveying roller pair 32 is disposed on the downstream side of the pickup roller 31 in the feeding direction. The conveying roller pair 32 pinches the sheet S pulled out from the setting plate 1 by the pickup roller 31, and rotates. In this way, the conveying roller pair 32 conveys the sheet S to the image forming apparatus 1000. The number of disposed conveying roller pairs 32 is not particularly limited, but it can be changed depending on factors such as a conveying path length for the sheet S from the pickup roller 31 to the image forming apparatus 1000.

The sheet S on the setting plate 1 is sent out from the right side to the left side in the second direction D2. In other words, on the setting plate 1, the left side end of the sheet S in the second direction D2 is a front end, while the right side end of the sheet S in the second direction D2 is a rear end. In addition, on the setting plate 1, the first direction D1 (i.e., the front and back direction) is a width direction of the sheet S.

Note that the elevating mechanism 2 moves the setting plate 1 upward, so as to allow the pickup roller 31 to contact the top one of the sheets S on the setting plate 1. In a case where the sheets S are fed continuously from the sheet storage device 100 to the image forming apparatus 1000, the elevating mechanism 2 repeats moving the setting plate 1 upward and stopping the same. In this way, the contact between the pickup roller 31 and the top one of the sheets S on the setting plate 1 is maintained.

Figure 6:
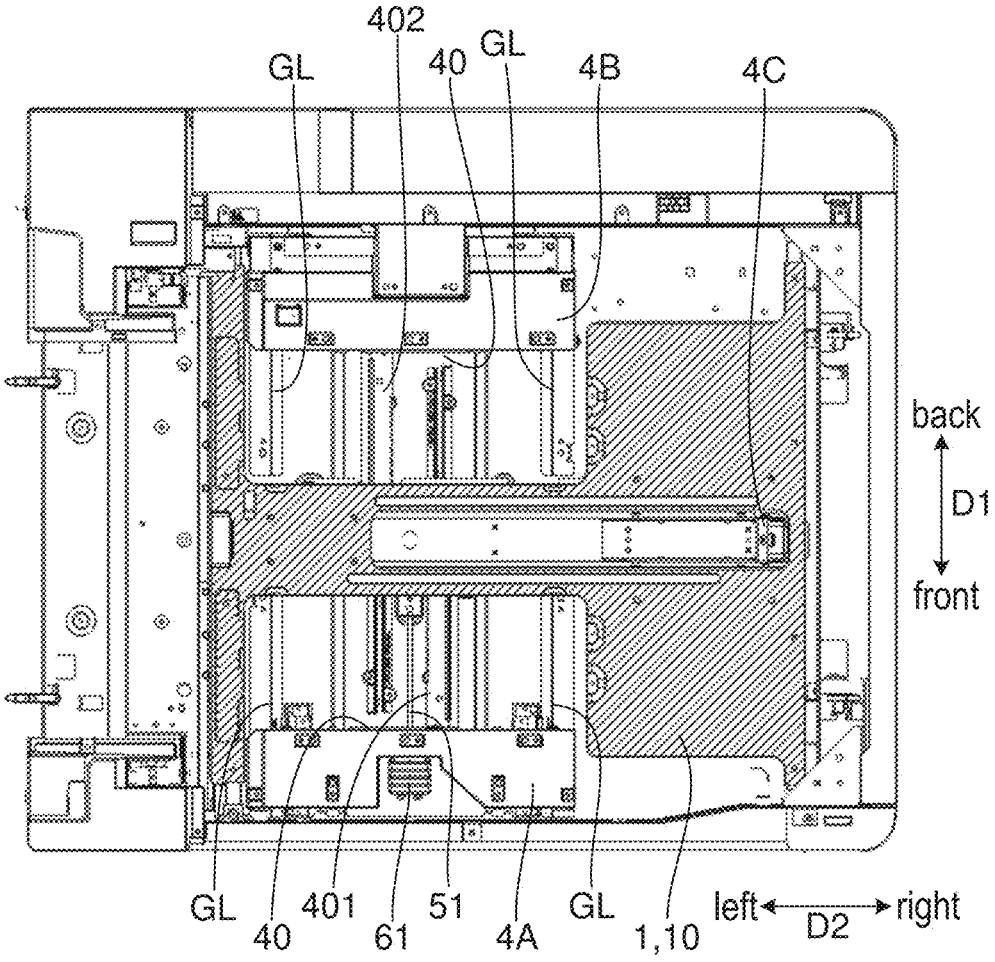
FIG. 6 is a plan view of a sheet storage region of the sheet storage device according to the embodiment, viewed from above.

As illustrated in FIG. 6, the sheet storage device 100 includes width direction regulation cursors 4A and 4B, and a rear end regulation cursor 4C. The width direction regulation cursor 4A, the width direction regulation cursor 4B, and the rear end regulation cursor 4C are supported in a manner capable of reciprocating in the horizontal direction. The width direction regulation cursor 4A, the width direction regulation cursor 4B, and the rear end regulation cursor 4C are moved in the horizontal direction by user's operation. Then, the width direction regulation cursor 4A, the width direction regulation cursor 4B, and the rear end regulation cursor 4C contact edges of the sheet S set on the setting plate 1 from the horizontal direction. In this way, the width direction regulation cursor 4A, the width direction regulation cursor 4B, and the rear end regulation cursor 4C regulate positional deviations in the horizontal direction of the sheet S on the setting plate 1.

The width direction regulation cursors 4A and 4B move in the first direction D1, and contact the edges of the sheet S on the setting plate 1 in the first direction D1, so as to regulate a positional deviation in the first direction D1 of the sheet S on the setting plate 1. Note that the width direction regulation cursors 4A and 4B sandwich the sheet S on the setting plate 1 in the first direction D1. The rear end regulation cursor 4C moves in the second direction D2, and contacts the edge of the sheet S on the setting plate 1 in the second direction D2, so as to regulate a positional deviation in the second direction D2 of the sheet S on the setting plate 1.

Note that when viewing from above, the setting plate 1 has openings (no numeral) on moving paths of the width direction regulation cursors 4A and 4B, and an opening (no numeral) on a moving path of the rear end regulation cursor 4C. Therefore, when the width direction regulation cursors 4A and 4B move in the first direction D1, they do not contact the setting plate 1. When the rear end regulation cursor 4C moves in the second direction D2, it does not contact the setting plate 1. In other words, viewed from above, even if the sheet S is smaller than the setting plate 1, the width direction regulation cursors 4A and 4B can contact the edges of the sheet S without contacting the setting plate 1, and the rear end regulation cursor 4C can contact the edge of the sheet S without contacting the setting plate 1. In FIG. 6, the setting plate 1 is shown with hatching.

The width direction regulation cursor 4A contacts the edge of the sheet S from the front side in the first direction D1, and the width direction regulation cursor 4B contacts the edge of the sheet S from the back side in the first direction D1. Specifically, the width direction regulation cursors 4A and 4B each have a plate-like side surface part 40 that contacts the edge of the sheet S. The side surface part 40 of each of the width direction regulation cursors 4A and 4B stands in the up and down direction, and its thickness direction is the first direction D1. The side surface parts 40 of the width direction regulation cursors 4A and 4B face each other in the first direction D1.

The width direction regulation cursors 4A and 4B move in the first direction D1 in an interlocking manner. When the width direction regulation cursor 4A moves backward, the width direction regulation cursor 4B moves frontward, and hence an interval between the width direction regulation cursors 4A and 4B in the first direction D1 becomes smaller. When width direction regulation cursor 4A moves frontward, the width direction regulation cursor 4B moves backward, and hence the interval between the width direction regulation cursors 4A and 4B in the first direction D1 becomes larger.

Figure 7:
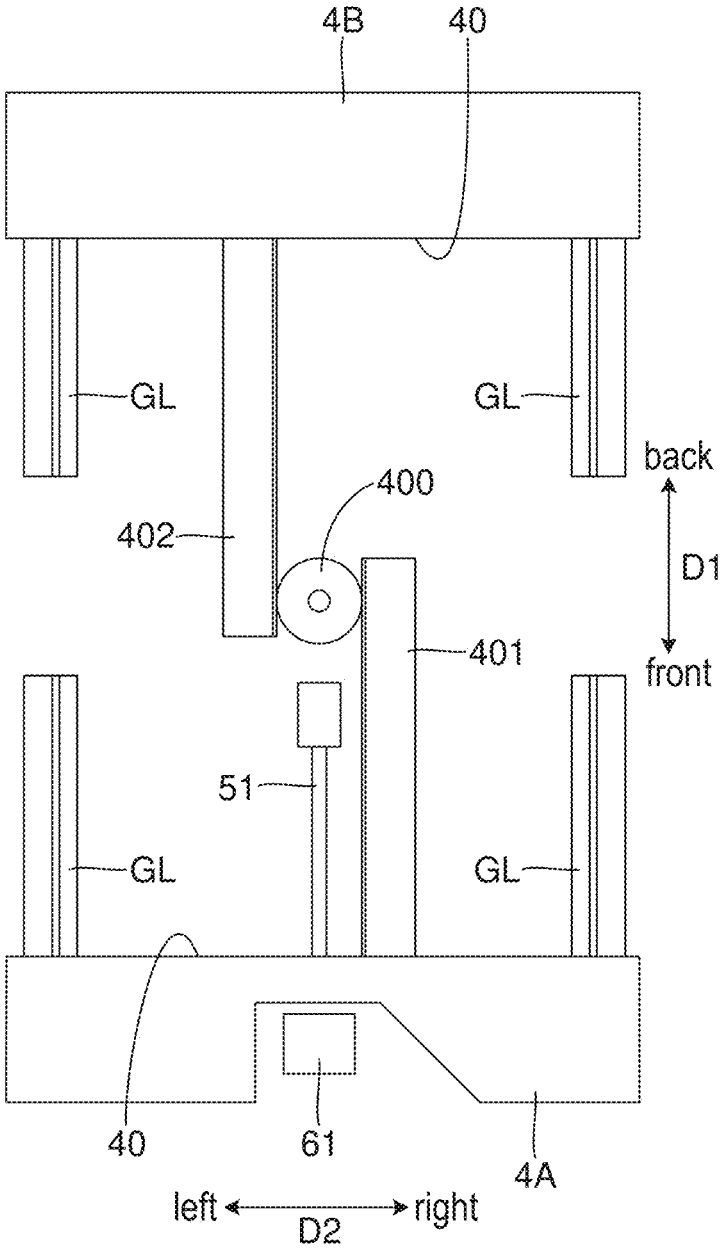
FIG. 7 is a schematic diagram (a plan view viewed from above) of a mechanism for moving a pair of width direction regulation cursors of the sheet storage device according to the embodiment.
Figure 8:
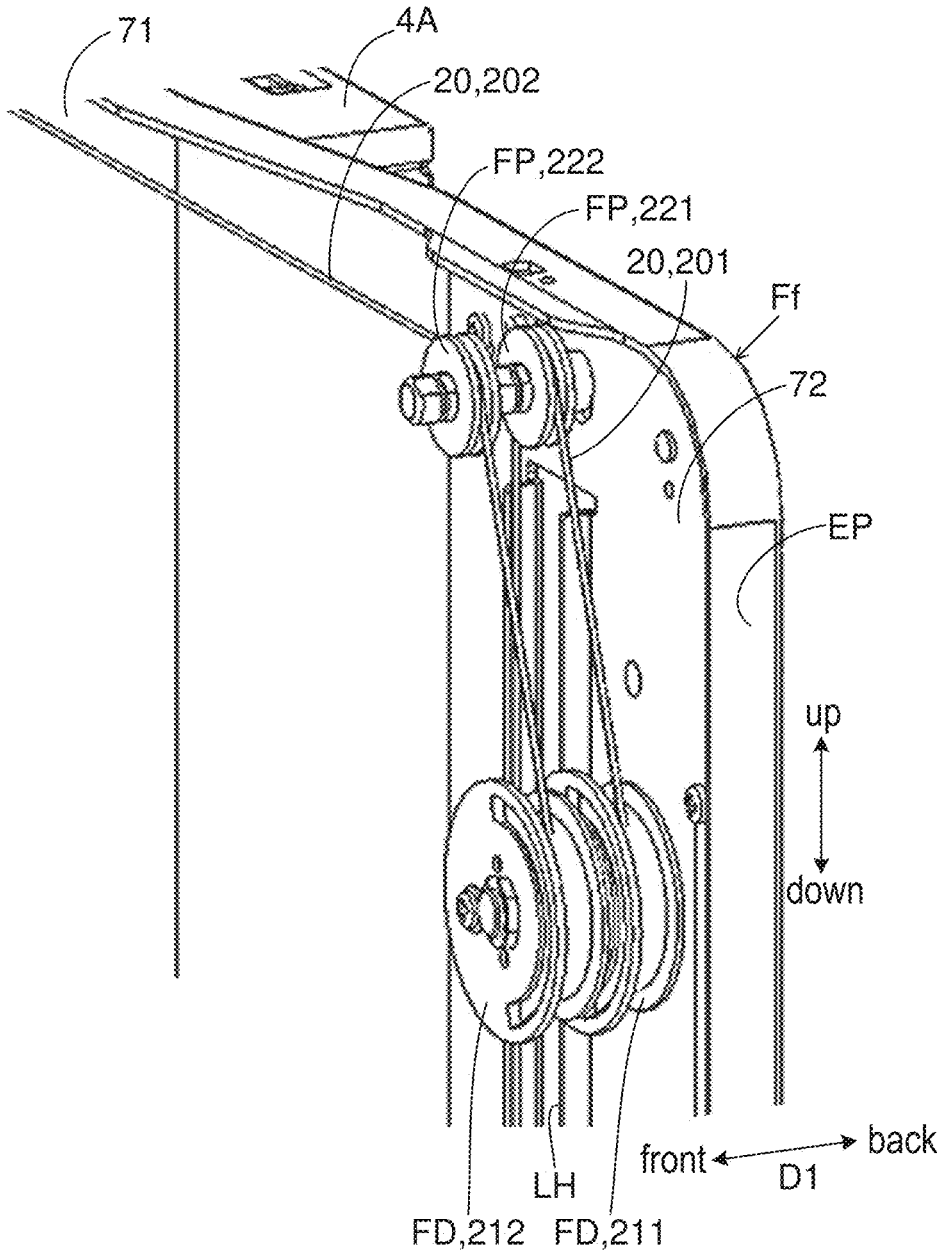
FIG. 8 is a perspective view of a front side winding drum and its vicinity of the sheet storage device according to the embodiment.

In order to move the width direction regulation cursors 4A and 4B in the first direction D1 in an interlocking manner, as illustrated in FIG. 7, the width direction regulation cursor 4A is provided with a rack 401 that extends backward in the first direction D1, and the width direction regulation cursor 4B is provided with a rack 402 that extends frontward in the first direction D1. Between the racks 401 and 402 in the second direction D2, there is disposed a gear 400 that rotates about an axis extending in the up and down direction. The gear 400 engages with the racks 401 and 402.

Note that when moving the width direction regulation cursors 4A and 4B in the first direction D1, a user operates width direction regulation cursor 4A so as to move the width direction regulation cursor 4A in the first direction D1. In other words, the width direction regulation cursor 4A is supported in a manner capable of reciprocating by manual operation (i.e., by user's operation). In this structure, the width direction regulation cursor 4A corresponds to a "regulation cursor".

In order to enable reciprocating movement of the width direction regulation cursor 4A in the first direction D1, the sheet storage device 100 is equipped with a cursor movement mechanism including a guide shaft 51, a guide rail GL, and the like. The guide shaft 51 and the guide rail GL extend in the first direction D1, so as to guide reciprocating movement of the width direction regulation cursor 4A in the first direction D1. In addition, the cursor movement mechanism includes a stopper (not shown). The stopper is linked with the width direction regulation cursor 4A.

The stopper has a guide hole in which the guide shaft 51 is inserted. When the stopper is inclined, frictional resistance between the guide shaft 51 and inner edge of the guide hole restricts movement of the width direction regulation cursor 4A in the first direction D1. Note that the stopper is biased by a biasing member (not shown) such as a coil spring so that the stopper is normally inclined.

The cursor movement mechanism includes a lever 61 to allow the stopper to change from the inclined state to a standing state. The lever 61 is operated by the user. When the lever 61 is operated, it presses the stopper in the direction in which the stopper changes from the inclined state to a standing state. When the lever 61 is operated, the stopper in the inclined state is raised, and the stopper changes to the standing state. In this way, the reciprocating movement of the width direction regulation cursor 4A in the first direction D1 is enabled.

Some structural members such as the lever 61 of the cursor movement mechanism are attached to the width direction regulation cursor 4A. Therefore, in the case where the cursor movement mechanism is disposed in the sheet storage device 100, the size of the width direction regulation cursor 4A in the first direction D1 is larger than that in the case where the cursor movement mechanism is not disposed. Therefore, in the case where the cursor movement mechanism is disposed in the sheet storage device 100, it is necessary to increase at least the region in which the width direction regulation cursor 4A is disposed, in the first direction D1, in the region between the front frame Ff and the rear frame Fr in the first direction D1.

<Structure of Front Frame>

Figure 9:
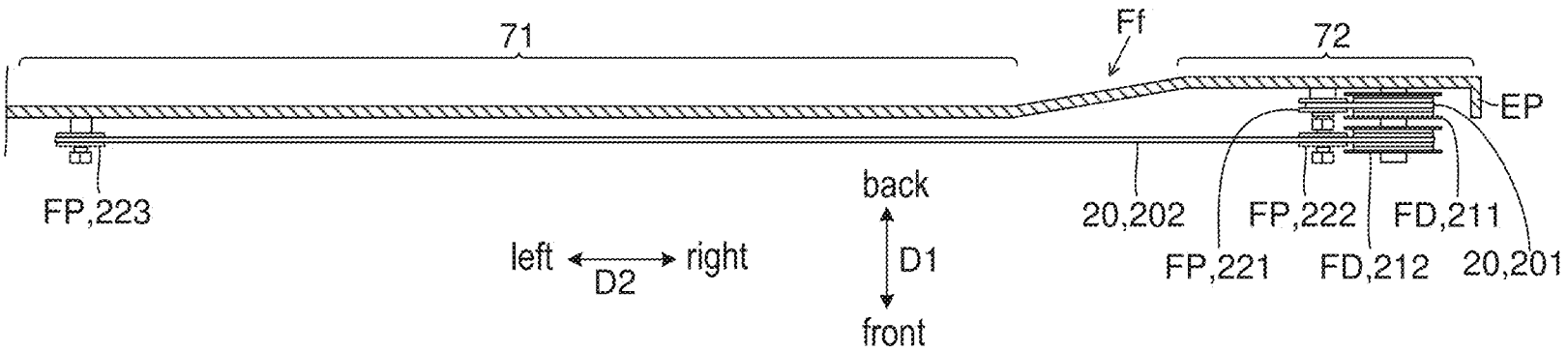
FIG. 9 is a diagram of individual members arranged on a front side of a front frame of the sheet storage device according to the embodiment, viewed from above.
Figure 10:
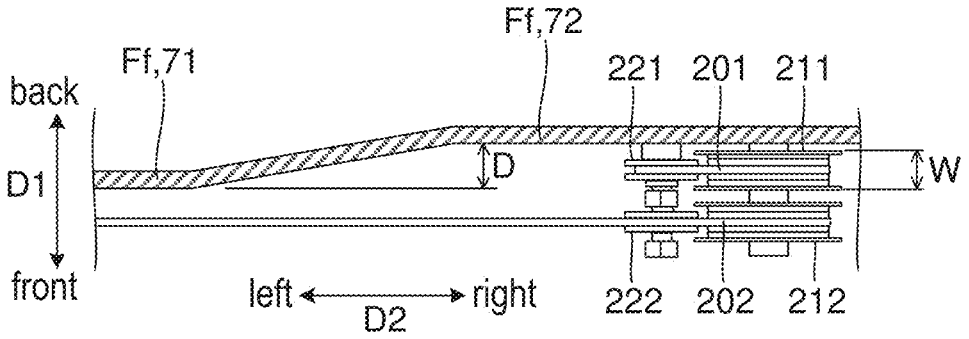
FIG. 10 is an enlarged view of the front side winding drum and its vicinity illustrated in FIG. 9.

Hereinafter, with reference to FIGS. 3 and 8 to 10, a structure of the front frame Ff is described. Note that the front frame Ff has a part EP bent outward in the first direction D1 over substantially the entire circumference (see FIGS. 3, 8, and 9). FIGS. 9 and 10 correspond to cross sections of the upper end part of the front frame Ff including the part EP taken along the horizontal direction. Therefore, in FIGS. 9 and 10, the front frame Ff is shown with hatching.

The front frame Ff is a plate-like frame having a main frame part 71 and a drum arrangement part 72. In other words, the front frame Ff corresponds to a "predetermined frame". In this structure, the front side winding drums FD (i.e., the first winding drum 211 and the second winding drum 212) correspond to "winding drums on the predetermined frame side". In addition, the front side relay pulleys FP (i.e., the first relay pulley 221, the second relay pulley 222, and the third relay pulley 223) correspond to "relay pulleys on the predetermined frame side". Further, in this structure, the rear frame Fr corresponds to "the other frame than the predetermined frame".

The front surface part of the front frame Ff whose thickness direction is the first direction D1 has the main frame part 71 and the drum arrangement part 72. Note that the front frame Ff integrally has the main frame part 71 and the drum arrangement part 72. In other words, the drum arrangement part 72 is not a member attached afterward to the main frame part 71.

The main frame part 71 is a part other than the right side end part of the front frame Ff in the second direction D2. The main frame part 71 is positioned outward of the width direction regulation cursor 4A in the first direction D1. In other words, the main frame part 71 covers the width direction regulation cursor 4A from outward in the first direction D1. Further, in other words, the width direction regulation cursor 4A faces the main frame part 71 in the first direction D1.

The drum arrangement part 72 is the right side end part of the front frame Ff in the second direction D2. The drum arrangement part 72 is a part positioned on the right side of the main frame part 71 in the second direction D2. The drum arrangement part 72 is a part positioned on the right side of the width direction regulation cursor 4A in the second direction D2. In other words, the main frame part 71 faces the width direction regulation cursor 4A in the first direction D1, while the drum arrangement part 72 does not face the width direction regulation cursor 4A in the first direction D1.

The front side winding drum FD is disposed in the drum arrangement part 72. The first relay pulley 221 is disposed in the drum arrangement part 72. The first relay pulley 221 is disposed on the left side of the front side winding drum FD in the second direction D2, in the drum arrangement part 72. Note that the second relay pulley 222 is disposed on the same axis as the first relay pulley 221, outward of the first relay pulley 221 in the first direction D1. In other words, the second relay pulley 222 is disposed in the drum arrangement part 72. The third relay pulley 223 is disposed in the main frame part 71.

Here, the drum arrangement part 72 is positioned inward of the main frame part 71 in the first direction D1. For instance, the front frame Ff is made of a single sheet material. Note that the sheet material constituting the front frame Ff is metal sheet. Further, a part of the single sheet material is bent and recessed from a part to be the main frame part 71. In this way, it is easy to obtain the front frame Ff having the drum arrangement part 72 recessed inward in the first direction D1 from the main frame part 71.

In this embodiment, as the drum arrangement part 72 is positioned inward of the main frame part 71 in the first direction D1, the size of the sheet storage device 100 in the first direction D1 can be reduced. In other words, the sheet storage device 100 can be downsized.

Specifically, the first winding drum 211 is disposed in the drum arrangement part 72. In addition, the first relay pulley 221 is disposed in the drum arrangement part 72. Therefore, in the case where the drum arrangement part 72 is positioned inward of the main frame part 71 in the first direction D1, at least a part of the first winding drum 211 is inward of the main frame part 71 in the first direction D1. Similarly, at least a part of the first relay pulley 221 is inward of the main frame part 71 in the first direction D1. In this way, in the case where the drum arrangement part 72 is positioned inward of the main frame part 71 in the first direction D1, the size of the sheet storage device 100 in the first direction D1 is smaller than that in the case where the position of the drum arrangement part 72 in the first direction D1 is the same as that of the main frame part 71.

Note that the first wire 201 is linked with the first winding drum 211. The first wire 201 wraps around only the first relay pulley 221. Therefore, even if the first winding drum 211 and the first relay pulley 221 are completely inward of the main frame part 71 in the first direction D1, the first wire 201 does not contact the front frame Ff.

Therefore, in this embodiment, a distance D between the main frame part 71 (the front surface thereof) and the drum arrangement part 72 (the front surface thereof) in the first direction D1 is larger than or equal to a width W of the first winding drum 211 in the first direction D1. In this way, the first winding drum 211 can be completely inward of the main frame part 71 in the first direction D1. In addition, as the width of the first relay pulley 221 in the first direction D1 is smaller than the width W of the first winding drum 211 in the first direction D1, the first relay pulley 221 can also be completely inward of the main frame part 71 in the first direction D1.

The width W of the first winding drum 211 in the first direction D1 means a width in the first direction D1 of a drum part of the first winding drum 211, on which the first wire 201 winds, and does not include the rotation shaft of the first winding drum 211. The width of the first relay pulley 221 in the first direction D1 means a width in the first direction D1 of a part on which the first wire 201 wraps around, and does not include the rotation shaft of the first relay pulley 221.

In this way, if the distance D between the main frame part 71 and the drum arrangement part 72 in the first direction D1 is more than or equal to the width W of the first winding drum 211 in the first direction D1, the first winding drum 211 and the first relay pulley 221 can be inward of the main frame part 71 in the first direction D1. However, if the distance D between the main frame part 71 and the drum arrangement part 72 in the first direction D1 is too large, the second winding drum 212 and the second relay pulley 222 may be inward of the main frame part 71 in the first direction D1. In this case, as the third relay pulley 223 is disposed outward of the main frame part 71 in the first direction D1, the second wire 202 can hardly wrap around them.

Therefore, in this embodiment, the second winding drum 212 and the second relay pulley 222 are disposed outward of the main frame part 71 in the first direction D1. In other words, the distance D between the main frame part 71 and the drum arrangement part 72 in the first direction D1 is set so that the second winding drum 212 and the second relay pulley 222 are disposed outward of the main frame part 71 in the first direction D1. In this way, even if the drum arrangement part 72 is positioned inward of the main frame part 71 in the first direction D1, the second wire 202 linked with the second winding drum 212 can easily wrap around the second relay pulley 222 and the third relay pulley 223.

In addition, in this embodiment, the main frame part 71 is positioned outward of the width direction regulation cursor 4A in the first direction D1, while the drum arrangement part 72 is positioned on the right side of the width direction regulation cursor 4A in the second direction D2 (i.e., on the one side in the second direction D2). The width direction regulation cursor 4A is not inward of the drum arrangement part 72 in the first direction D1. In this way, even if the position of the drum arrangement part 72 in the first direction D1 is inward of the main frame part 71 in the first direction D1, the drum arrangement part 72 does not contact the width direction regulation cursor 4A.

<Variation>

Figure 11:
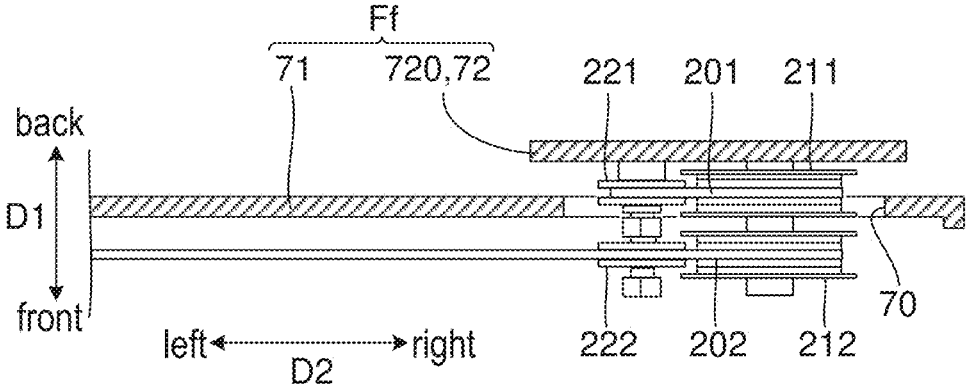
FIG. 11 is a diagram illustrating a structure of the front frame of the sheet storage device according to a variation.

In a variation, as illustrated in FIG. 11, the front frame Ff has a plate-like member 720 as the drum arrangement part 72 separately from the main frame part 71. The plate-like member 720 as the drum arrangement part 72 may be attached to the main frame part 71, or may be attached to another frame of the sheet storage device 100.

As the plate-like member 720 is used as the drum arrangement part 72, the front frame Ff is provided with an opening 70 that penetrates in the first direction D1. The front frame Ff has the opening 70 on the right side of the main frame part 71 in the second direction D2.

In addition, the plate-like member 720 as the drum arrangement part 72 is disposed inward of the main frame part 71 in the first direction D1. The plate-like member 720 is exposed from the opening 70 outward in the first direction D1. Further, the front side winding drum FD (i.e., the first winding drum 211 and the second winding drum 212), the first relay pulley 221, and the second relay pulley 222 are disposed on the plate-like member 720.

Here, the first winding drum 211 and the first relay pulley 221 are disposed inward of the main frame part 71 in the first direction D1. On the other hand, the second winding drum 212 and the second relay pulley 222 protrude through the opening 70 outward of the main frame part 71 in the first direction D1.

In the variation, the plate-like member 720 (i.e., the drum arrangement part 72) is disposed inward of the main frame part 71 in the first direction D1, and the front side winding drum FD, the first relay pulley 221, and the second relay pulley 222 is disposed on the plate-like member 720, and thus the size of the sheet storage device 100 in the first direction D1 can be reduced. In addition, as the second winding drum 212 and the second relay pulley 222 protrude through the opening 70 outward of the main frame part 71 in the first direction D1, the second wire 202 can wrap around them without difficulty.

The embodiment disclosed in this specification is merely an example in every aspect, and should not be interpreted as a limitation. The scope of the present disclosure is defined not by the above description of the embodiment but by the claims, and should be understood to include all modifications within meaning and scope equivalent to the claims.

What is claimed is:

1. A sheet storage device comprising:

a setting plate on which a sheet is set, the setting plate being capable of reciprocating in an up and down direction;

a pair of frames disposed to face each other with the setting plate between them, the pair of frames each being a plate, in a first direction perpendicular to the up and down direction:

wires linked with both end parts of the setting plate in the first direction;

a plurality of winding drums disposed outward of each of the pair of frames in the first direction, so as to be linked with the wires and be rotatable about an axis extending in the first direction, the winding drums being rotated in one direction so as to wind the wires and move the setting plate upward, while being rotated in the other direction so as to unwind the wires and move the setting plate downward; and a plurality of relay pulleys disposed outward of each of the pair of frames in the first direction, in a rotatable manner about an axis extending in the first direction, the wires being wrapped around the relay pulleys, wherein a predetermined frame out of the pair of frames includes a main frame part, and a drum arrangement part positioned on one side of the main frame part in a second direction perpendicular to the first direction, the wires include a first wire linked with one side end part of the setting plate in the second direction, on a predetermined frame side, and a second wire linked with the other side end part of the setting plate in the second direction, on the predetermined frame side, the winding drums on the predetermined frame side out of the plurality of winding drums are disposed in the drum arrangement part, the relay pulleys on the predetermined frame side out of the plurality of relay pulleys include a first relay pulley disposed in the drum arrangement part, for the first wire to wrap around, a second relay pulley disposed on the same axis as the first relay pulley, outward of the first relay pulley in the first direction, for the second wire to wrap around, and a third relay pulley disposed in the main frame part, for the second wire to wrap around, the drum arrangement part is positioned inward of the main frame part in the first direction, the winding drums on the predetermined frame side include a first winding drum linked with the first wire, and a second winding drum disposed on the same axis as the first winding drum, outward of the first winding drum in the first direction, so as to be linked with the second wire, and a distance between the main frame part and the drum arrangement part in the first direction is more than or equal to a width of the first winding drum in the first direction.

2. The sheet storage device according to claim 1, wherein the second winding drum and the second relay pulley are disposed outward of the main frame part in the first direction.

3. The sheet storage device according to claim 1, wherein the predetermined frame is made of single sheet material, and the drum arrangement part is a part of the sheet material bent and recessed inward of the main frame part in the first direction.

4. The sheet storage device according to claim 1, wherein the predetermined frame has a plate member that is another member than the main frame part, as the drum arrangement part, the predetermined frame has an opening penetrating in the first direction, on one side of the main frame part in the second direction, the plate member is disposed inward of the main frame part in the first direction and is exposed through the opening outward in the first direction, and the winding drums, the first relay pulley, and the second relay pulley on the predetermined frame side are disposed on the plate member.

5. The sheet storage device according to claim 1, further comprising a regulation cursor supported in a manner capable of reciprocating in the first direction, the regulation cursor being configured to contact an edge of the sheet on the setting plate from the first direction, so as to regulate positional deviation of the sheet in the first direction, wherein the main frame part is positioned outward of the regulation cursor in the first direction, and the drum arrangement part is positioned on one side of the regulation cursor in the second direction.

6. The sheet storage device according to claim 1, further comprising a winding motor configured to rotate the plurality of winding drums, wherein the winding motor is disposed outward in the first direction of the other frame than the predetermined frame out of the pair of frames.

7. An image formation system comprising:

the sheet storage device according to claim 1; and an image forming apparatus linked with the sheet storage device, wherein the sheet storage device feeds the image forming apparatus with the sheet, and the image forming apparatus performs printing on the sheet fed from the sheet storage device.

* * * * *